US006779773B2

(12) United States Patent
Chen

(10) Patent No.: US 6,779,773 B2
(45) Date of Patent: Aug. 24, 2004

(54) IMPRESSION MOLD

(76) Inventor: Jui-Wen Chen, Room B, 10F, No. 415, Chung-Cheng Rd., Shu-Lin City, Taipei Hsien (TW)

( * ) Notice: Subject to any disclaimer, the term of this patent is extended or adjusted under 35 U.S.C. 154(b) by 0 days.

(21) Appl. No.: 10/175,915

(22) Filed: Jun. 21, 2002

(65) Prior Publication Data

US 2003/0234340 A1 Dec. 25, 2003

(51) Int. Cl.[7] ..... B29C 59/02

(52) U.S. Cl. ..... 249/104; 249/102; 425/93

(58) Field of Search ..... 249/102, 103, 249/104; 425/193, 385, 458; 404/89, 93

(56) References Cited

U.S. PATENT DOCUMENTS

| | | | | | |
|---|---|---|---|---|---|
| 215,633 | A | * | 5/1879 | Kinerson | 425/410 |
| 1,248,125 | A | * | 11/1917 | Jackson | 249/103 |
| 2,517,432 | A | * | 8/1950 | Hornberger | 249/141 |
| 5,061,172 | A | * | 10/1991 | Fennessy, Sr. | 425/385 |
| 5,487,656 | A | * | 1/1996 | Kaitanjian | 425/385 |

* cited by examiner

*Primary Examiner*—James P. Mackey
*Assistant Examiner*—Donald Heckenberg
(74) *Attorney, Agent, or Firm*—Troxell Law Office PLLC

(57) ABSTRACT

An impression mold includes a main body and a detachable segment. The main body has an obverse bearing a first intaglioed pattern, and is formed with an opening defined in the obverse thereof. The segment has an obverse bearing a second intaglioed pattern and has a shape complementary to the opening of the main body. Therefore, a complete pattern is formed by the two intaglioed patterns when the segment is fitted in the opening of the main body.

9 Claims, 8 Drawing Sheets

IMPRESSION MOLD

BACKGROUND OF THE INVENTION

1. Field of the Invention

The present invention relates to an impression mold and, more particularly, to an impression mold which may give a variable impression applied to pavements or walls simply by interchanging a detachable segment for another one.

2. Description of Prior Art

It can be found that some paths, e.g. sidewalks, were paved with brick. Due to their shapes and colors, these brick blocks may compose a pavement which is less variable in color and pattern on the top. Bunches of weeds may appear between the blocks and, particularly, the pavement may become depressed everywhere either by traffic or by rainstorm.

Further, FIG. 1 shows an impression mode for giving a raised impression to a continuous concrete pavement before the paving material becomes hard. Because the mode is an integral unit, it is necessary to make a lot of modes of such type for different patterns in the impressions. Furthermore, the impression mode usually results in many small cavities in the resulting impression because of the air gathered in the mode.

SUMMARY OF THE INVENTION

The object of the present invention is to provide an impression mold which may give a variable impression applied to pavements or walls simply by interchanging a detachable segment for another one.

Another object of the present invention is to provide an impression mold which may result in no small cavity in the resulting impression by expelling the air in the mold out from the vents positioned in the main body and detachable segment of the mold.

Other objects, advantages and novel features of the invention will become more apparent from the following detailed description when taken in conjunction with the accompanying drawings.

DETAILED DESCRIPTION OF THE PREFERRED EMBODIMENT

Figure 1:
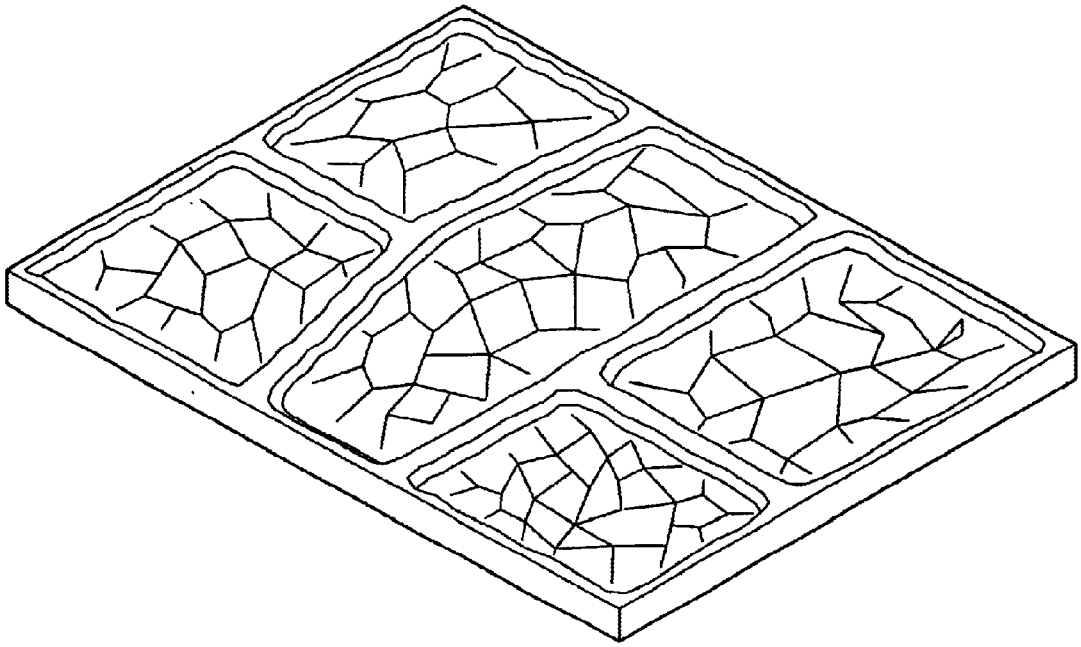
Fig. 1 (Prior Art)
FIG. 1 is a perspective view of a conventional impression mode.
Figure 2:
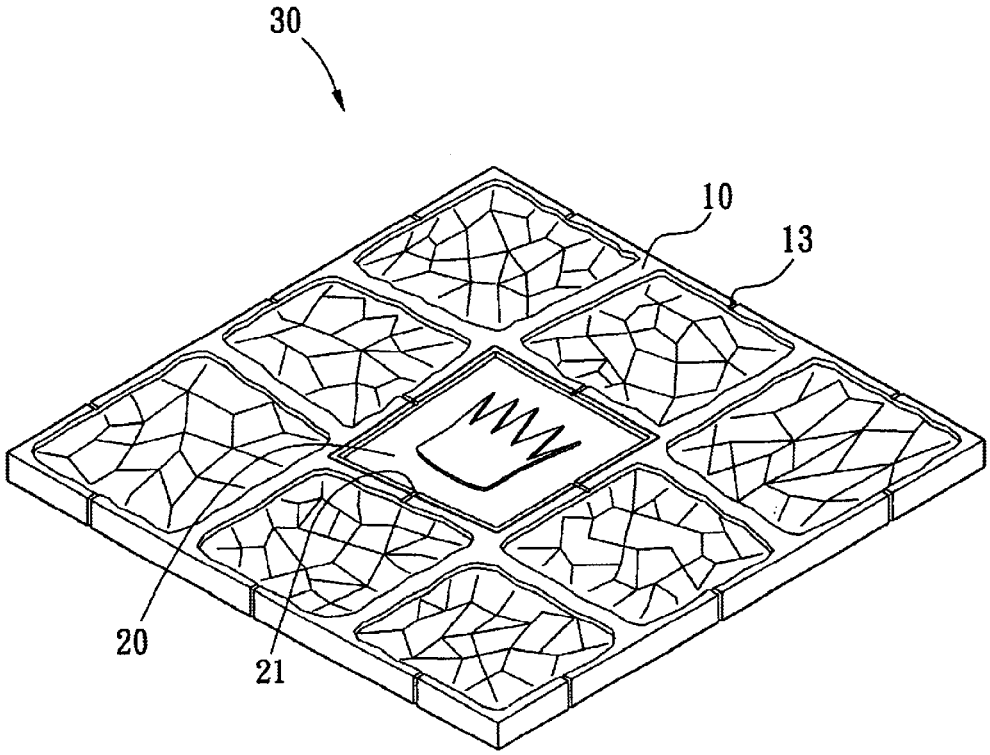
FIG. 2 is a perspective view of a preferred embodiment of an impression mode in accordance with the present invention.
Figure 3:
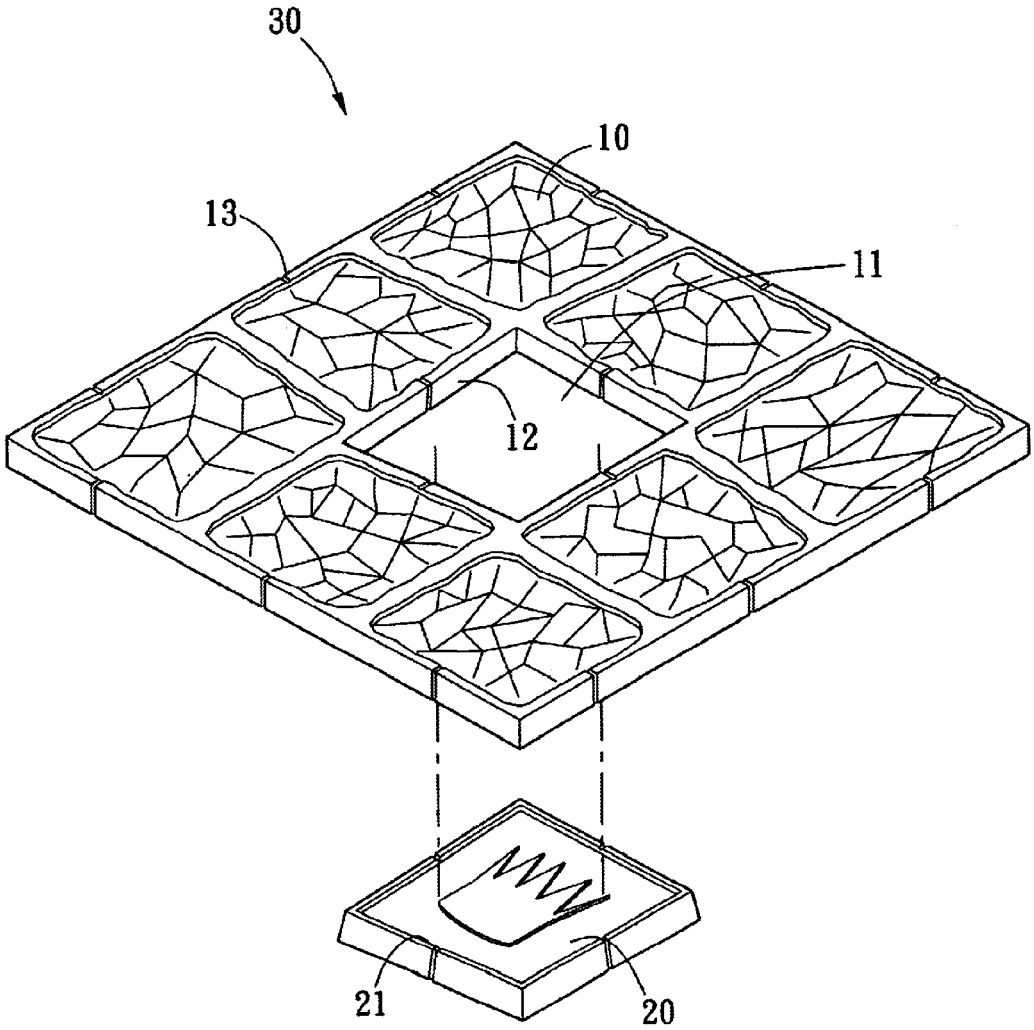
FIG. 3 is an exploded perspective view of the impression mode of FIG. 2.

Referring to FIGS. 2 and 3, there is shown a preferred embodiment of an impression mold 30 in accordance with the present invention for giving a raised impression, such as to a concrete pavement/wall. The impression mold 30 includes a main body 10 and a detachable segment 20, each being configured as a plate.

The main body 10 has an obverse bearing a first intaglioed pattern. The main body 10 is further formed with an opening 11 defined in its observe for receiving the segment 20, and a plurality of first vents 13 distributed along its perimeter to help expel the air out from the main body 10. The segment 20, with a shape complementary to the opening 11, has an obverse bearing a second intaglioed pattern and is formed with a plurality of second vents 21 distributed along its perimeter to help expel the air out from the segment 20.

Figure 5:
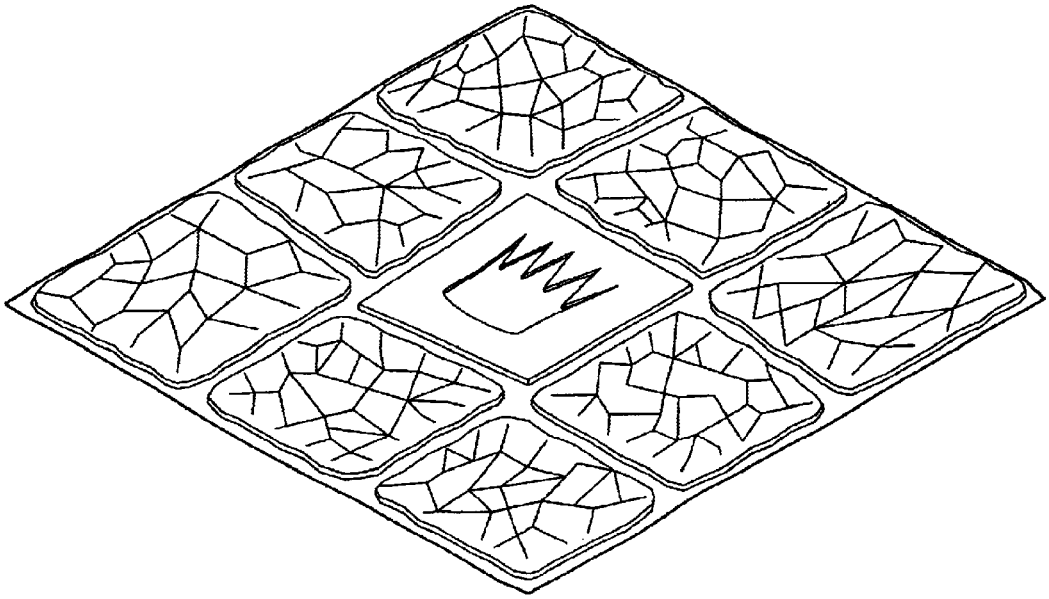
FIG. 5 is a perspective view of a raised impression acquired from by the mode of FIG. 2.

When the segment 20 is fitted in the opening 11 of the main body 10, a complete pattern is then formed by the intaglioed patterns, as shown in FIG. 5.

Figure 4A:
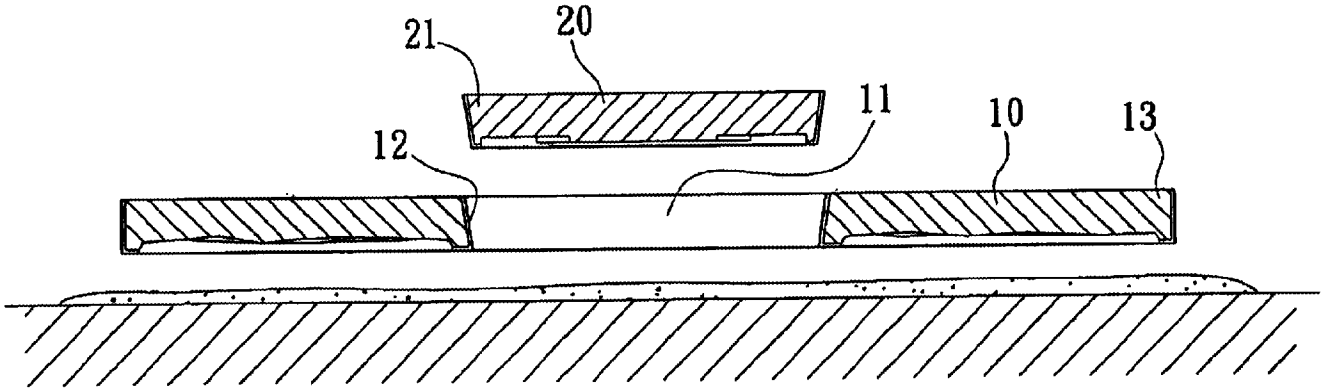
FIG. 4*a* is a sectional view of the impression mode of FIG. 2, showing the mode to be placed on a concrete layer.
Figure 4B:
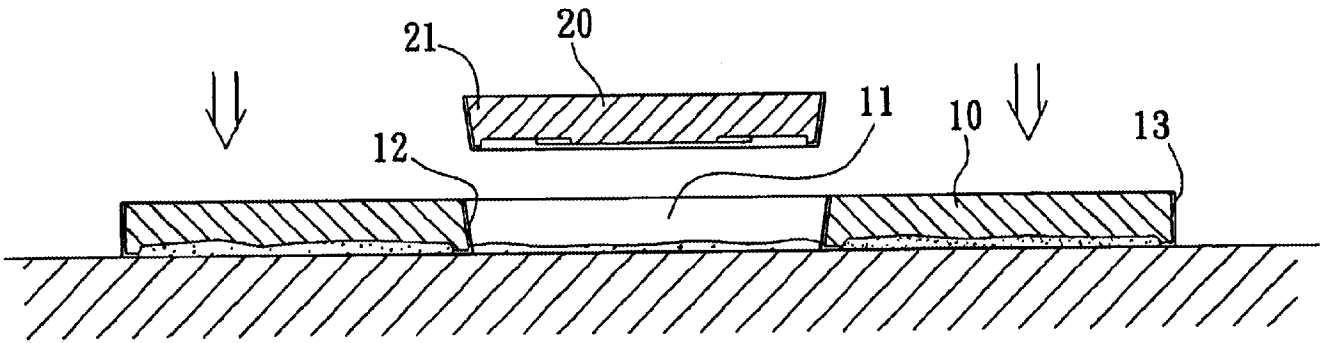
FIG. 4*b* is a sectional view of the impression mode of FIG. 2, showing a main body placed on the concrete layer but a segment removed from the body.
Figure 4D:
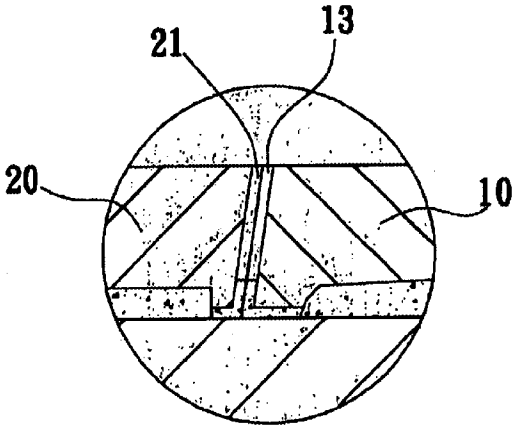
FIG. 4*d* is an enlarged view of area A in FIG. 4*c*.
Figure 4C:
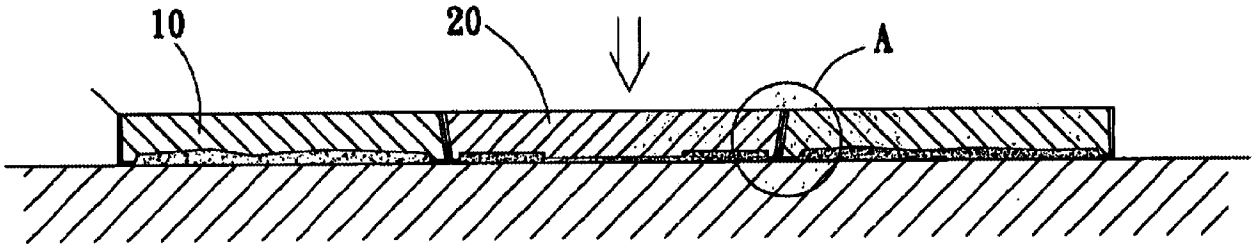
FIG. 4*c* is a sectional view of the mode of FIG. 2.

Referring to FIGS. 4*a* and 4*b*, the impression mode must be applied to the pavement/wall before the concrete layer became hard. In prior to the application, the concrete layer is preferably applied with a colored hardener, which should be spread out with a trowel, before the mode is placed on and pressed against the soft layer.

A raised, colored impression then appears in the pavement/wall, as shown in FIG. 5, as soon as the inventive mode is removed. Once the concrete layer became hard, excessive hardener or other foreign matter may be cleared away and the colored impression may become more bright than ever.

The whole pavement/wall may be treated time after time with single one mode or, alternatively, with a group of such modes at a time. Whether one of more such modes are used, air between the mode(s) and the concrete layer may be expelled through the vents 13 and 21 of the main body 10 and the segment 20, especially during the course when the mode(s) is/are pressed down, thereby leaving no bubble or small cavity in the resulting impression.

If necessary, the detachable segment 20 may be interchanged for a substituting one that has an obverse bearing a differently intaglioed pattern, in order to acquire an impression different in pattern and style.

Referring to FIG. 4*b*, the opening 11 is preferably defined by a peripheral surface 12 flared from the obverse of the main body 10 while the segment 10 is bounded by a peripheral surface inclined in correspondence with the surface 12. This allows the segment 20 to be easily detached from the main body 10 with the body 10 remaining on the soft concrete layer.

A differently colored harden then can be applied to the area within the opening 11 to achieve an impression that is different in color within the particular area. Alternatively, a certain amount of concrete may be added to or removed from the area within the opening 11 to achieve a final impression that is slightly raised or lowered within the particular area.

It can also be appreciated that the flared surface 12 enables the main body 10 to be removed from the concrete layer together with the segment 20.

Figure 6:
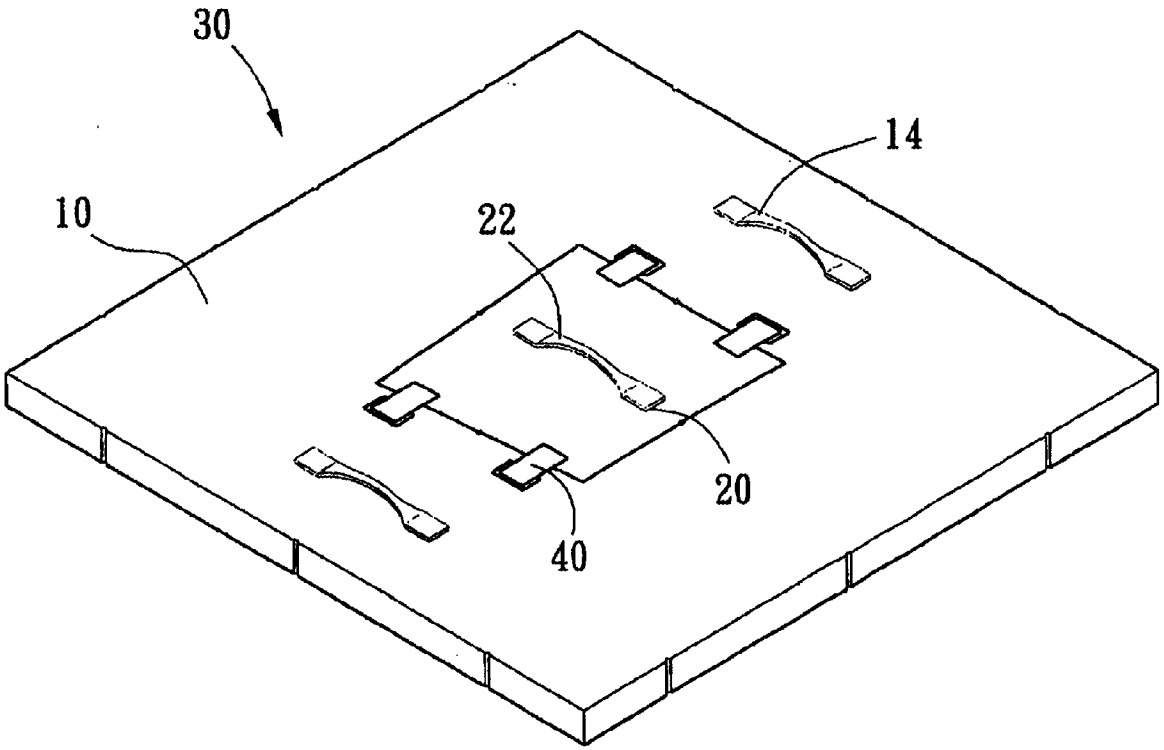
FIG. 6 is a perspective view of another preferred embodiment of the impression mode in accordance with the present invention.
Figure 7B:
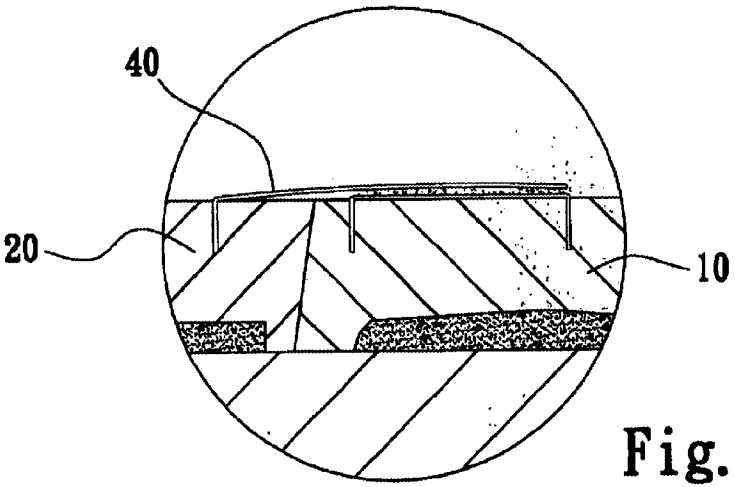
FIG. 7*b* is an enlarged view of area B in FIG. 7*a*.
Figure 7A:
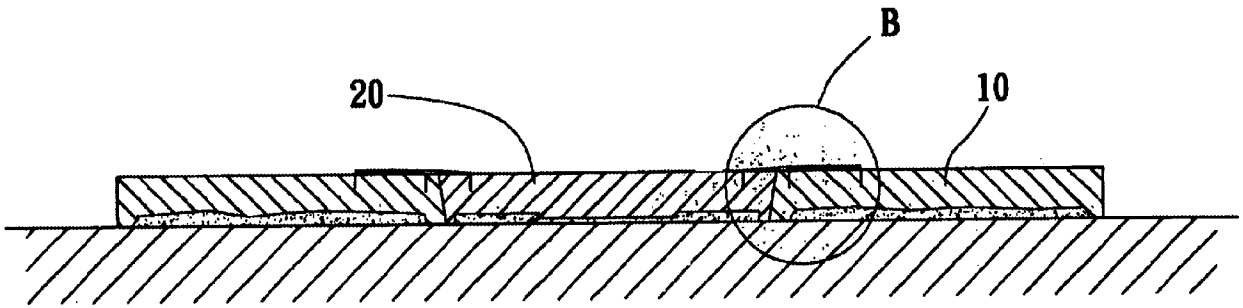
FIG. 7*a* is a sectional view of the impression mode of FIG. 6.

Referring to FIGS. 6 and 7, in a highly preferred embodiment, the main body 10 has a plurality of first adhesive tapes 40 formed on the reverse thereof around the opening 11 and the segment 20 has a plurality of second adhesive tapes 40 detachably attached to the first adhesive tapes 40, as best seen in FIG. 7, thereby attaching the segment 20 to the main body 20 in a quick-detachable manner.

In addition, the main body 10 and the segment 20 here have respective handles 14 and 22 formed on the reverses thereof for removing the body 10 and the segment 20 more easily from the soft concrete layer.

From the foregoing, it is apparent that the present invention has the following advantages:

1. enabling the pattern and style of the raised impression to vary upon the interchanging of the particular segment 20 to improve the aesthetic appearance of the pavements or walls;
2. providing the vents 13 and 21 on the main body and the segment and leaving no bubble or small cavity in the resulting impression; and
3. facilitating the formation of a differently colored or even raised or lowered area of the opening in the final impression.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An impression mold comprising:

a main body having an obverse bearing a first intaglioed pattern, said main body being formed with at least one opening defined in said obverse thereof; and a segment having an obverse bearing a second intaglioed pattern, said segment having a shape complementary to said opening of said main body;

whereby a complete pattern is formed by said first and second intaglioed patterns when said segment is fitted in said opening of said main body, wherein each of said main body and said segment is configured as a plate, wherein said opening is defined by peripheral surface flared from said obverse of said main body, and wherein said segment is bounded by a peripheral surface inclined in correspondence with said peripheral surface of said opening.

2. The impression mold as claimed in claim 1, wherein said main body has a plurality of first vents distributed along a perimeter thereof.

3. The impression mold as claimed in claim 1, wherein said segment is attached to said main body in a quick-detachable manner.

4. The impression mold as claimed in claim 1, wherein said segment has a plurality of second vents distributed along a perimeter thereof.

5. The impression mold as claimed in claim 1, wherein said main body and said segment have respective handles formed on reverses thereof.

6. An impression mold comprising:

a main body having an obverse bearing a first intaglioed pattern, said main body being formed with at least one opening defined in said obverse thereof; and a segment having an obverse bearing a second intaglioed pattern, said segment having a shape complementary to said opening of said main body;

whereby a complete pattern is formed by said first and second intaglioed patterns when said segment is fitted in said opening of said main body, wherein each of said main body and said segment is configured as a plate, wherein said main body has a plurality of first adhesive tapes formed on a reverse thereof around said opening, and wherein said segment has a plurality of second adhesive tapes detachably attached to said first adhesive tapes of said main body, thereby attaching said segment to said main body in a quick-detachable manner.

7. The impression mold as claimed in claim 6, wherein said main body has a plurality of first vents distributed along a perimeter thereof.

8. The impression mold as claimed in claim 6, wherein said segment has a plurality of second vents distributed along a perimeter thereof.

9. The impression mold as claimed in claim 6, wherein said main body and said segment have respective handles formed on reverses thereof.

* * * * *